US009765490B1

(12) United States Patent
Fanslow

(10) Patent No.: US 9,765,490 B1
(45) Date of Patent: Sep. 19, 2017

(54) AUTOMATED FLIP SIGN

(71) Applicant: Safety Technologies, Inc., Red Wing, MN (US)

(72) Inventor: Jared Fanslow, Red Wing, MN (US)

(73) Assignee: Safety Technologies, Inc., Red Wing, MN (US)

( * ) Notice: Subject to any disclaimer, the term of this patent is extended or adjusted under 35 U.S.C. 154(b) by 18 days.

(21) Appl. No.: 15/061,006

(22) Filed: Mar. 4, 2016

(51) Int. Cl.
*E01F 9/00* (2016.01)
*E01F 9/646* (2016.01)
*G09F 15/00* (2006.01)

(52) U.S. Cl.
CPC ..... *E01F 9/646* (2016.02); *G09F 15/0006* (2013.01)

(58) Field of Classification Search
CPC ..... G09F 15/0006; G09F 15/0087; G09F 2007/1878; E01F 9/646
See application file for complete search history.

(56) References Cited

U.S. PATENT DOCUMENTS 2,501,044 A 3/1950 Gianelloni, Jr.
2,528,962 A 11/1950 Lieutard
2,610,424 A 9/1952 Millard
3,256,629 A 6/1966 Whitman
3,616,557 A * 11/1971 Vara ..... G09F 7/22 40/602
3,914,890 A 10/1975 Behlen, Jr.
4,152,854 A * 5/1979 Berry, Jr. ..... B60Q 7/02 40/550
4,867,221 A * 9/1989 Dixon ..... E06B 3/94 160/199
4,999,938 A 3/1991 Behling
5,422,638 A 6/1995 Singer et al.
5,433,026 A * 7/1995 McDermott ..... G09F 21/04 248/292.14
5,703,577 A 12/1997 Carter
6,052,067 A 4/2000 Nuxoll
6,148,555 A 11/2000 Beauchamp et al.
6,150,957 A 11/2000 Henz et al.
6,761,000 B1 * 7/2004 Heijting ..... G09F 15/0056 160/135
6,956,502 B1 * 10/2005 Bartinelli ..... G08G 1/095 340/907
D556,617 S * 12/2007 Darolfi ..... D10/114.1
7,458,176 B1 12/2008 Schnabel
7,571,561 B1 8/2009 Garcia
8,164,483 B1 * 4/2012 Phillips ..... E01F 9/681 116/63 P
8,246,068 B2 8/2012 MacDougall
2002/0073586 A1 * 6/2002 Backe ..... G09F 7/00 40/612
2008/0291053 A1 * 11/2008 O'Brien ..... G08G 1/07 340/907
2011/0199235 A1 8/2011 John
2012/0206277 A1 8/2012 Cai
(Continued)

*Primary Examiner* — Charles A Fox
*Assistant Examiner* — Christopher E Veraa
(74) *Attorney, Agent, or Firm* — Haugen Law Firm PLLP

(57) ABSTRACT

A highway road sign is described that is capable of opening and folding to display or conceal information presented on a face of the road sign. The foldable sign of the invention is further capable of being opened and closed remotely and powered with solar energy. Additionally the foldable sign is operable when subjected to cross winds.

20 Claims, 28 Drawing Sheets

(56) References Cited

U.S. PATENT DOCUMENTS

| | | | | |
|---|---|---|---|---|
| 2015/0310781 | A1* | 10/2015 | Fisher | G09F 21/04 40/592 |
| 2016/0010350 | A1* | 1/2016 | Doucet | E04H 3/28 52/7 |
| 2016/0017554 | A1* | 1/2016 | Snyder | E01F 9/646 40/533 |

* cited by examiner

AUTOMATED FLIP SIGN

CROSS-REFERENCE TO RELATED APPLICATIONS

Not Applicable

FEDERAL SPONSORSHIP

Not Applicable

JOINT RESEARCH AGREEMENT

Not Applicable

TECHNICAL FIELD

This invention pertains generally to highway road signs. More particularly, the invention pertains to a highway road sign capable of opening and folding to display or conceal information presented on a face of the road sign. The folding of the roadway sign in accordance with the invention is further capable of opening and closing remotely. Power to the folding roadway sign may be provided with a solar energy. The foldable sign of the invention is also operable when subjected to cross winds.

BACKGROUND

Generally, traditional road signs have been built of a thicker gauge sheet metal in order to withstand extreme weather conditions. During roadway construction, a need still exists for sturdy roadway signs, however, separate specialized road signs have been utilized in order to convey temporary messages when crews are working in a work zone. When the work zones are inactive it may be preferred to block from visibility the message conveyed on the sign. Some localities or agencies may even mandate removal or blockage of work zone signage when crews are not present in the work zone. Additional sheet metal or covers may be added to the sign to block the messages when crews leave the work area. Alternatively, the specialized signs may be built in halves that are able to fold or flip. These folding signs may be used to block the message conveyed on the sign. Prior signs have required manual manipulation of the sign to alter the characteristics, position, or condition of the sign.

It is desirable to provide a folding sign that is rigid and sturdy and that does not have a wide gap between the halves when the sign is opened (making the message on the sign disjoint). Further, it is desirable to secure the two halves of the sign together in a way capable of withstanding significant winds when in the open or folded positions. Also, at times, it may be preferred to be able to remotely activate the opening and closing of the sign. For example, the sign may be positioned in a work zone area, at a location, making the conditions less than ideal to manually fold and secure the sign. And, during inclement weather, the manual folding of signs may be less than desirable.

SUMMARY

Embodiments according to aspects of the invention are rigid and sturdy and capable of automatically folding or flipping the two halves of a roadway sign between an open and closed position. According to other aspects, the apparatus of the invention to fold and open the roadway sign is capable of being activated remotely to either open or close the sign. Further, the activation of multiple roadway signs to open or close may be daisy chained together electronically such that an activation of one sign to an open or closed position results in subsequent activation of multiple corresponding signs. The invention may also utilize solar power to provide energy for the activation of the roadway sign between the open and closed position.

These and other embodiments according to aspects of the invention include an apparatus for folding a highway safety sign, wherein the apparatus includes at least one hinge, braces, mounts, a support member, and an actuator. The hinge includes two hinge mounts wherein each hinge mount is attached to a half of a roadway sign. A first brace is fixed to the first half of the sign and is further engaged to the first hinge mount of the hinge. Similarly, a second brace is fixed to the second half of the sign and is engaged to the second hinge mount of the hinge. The support member articulates at a mid-joint and has a first end pivotally attached to the first brace and a second end pivotally attached to the second brace. The actuator has a first end pivotally coupled to the hinge and has a second end pivotally coupled to the articulating support member.

The hinge portion of the apparatus of the invention may further have a first set of arms having first ends pivotally attached to the first hinge mount and having second ends slidingly engaged to the second hinge mount. Similarly, the hinge may have a second set of arms having first ends pivotally attached to the second hinge mount and having second ends slidingly engaged to the first hinge mount. Additionally, the hinge may include a pivot pin connecting mid portions of the first and second set of arms of the hinge. Also, a first end of the actuator may be pivotally coupled to at least one of the first and second set of arms of the hinge. According to aspects of the invention, an embodiment of the invention may further include first and second spaced apart outer hinges that are capable of coupling to the sign and wherein the hinge is positioned between the first and second spaced apart outer hinges. The actuator may be electrically coupled to a wireless power switching control that allows a user to send a signal to the switching control to activate the sign to an open or closed position. Further, a solar panel may supply energy to the switching control and the actuator.

Another embodiment according to aspects of the invention includes a sign having first and second separable halves, at least three floating hinges fixed or attached to the sign, braces attached to the sign and one of the floating hinges, an articulating support member, and an actuator. Each hinge may include a first hinge mount fixed to the first half of sign, a second hinge mount fixed to the second half of sign, a first set of arms having first ends pivotally attached to the first hinge mount and having second ends that slide in guideways of the second hinge mount, a second set of arms having first ends pivotally attached to the second hinge mount and having second ends that slide in guideways of the first hinge mount, and a pivot pin that connects mid portions of the first and second set of arms. A first brace is fixed to the first half of the sign and engaged to the first hinge mount of the third floating hinge and a second brace is fixed to the second half of the sign and engaged to the second hinge mount of the third floating hinge. The articulating support member has a first end pivotally attached to the first brace and a second end pivotally attached to the second brace. The actuator has a first end pivotally coupled to at least one of the first and second set of arms of the third floating hinge and has a second end pivotally coupled to a joint of the articulating support member.

According to aspects of the invention the actuator may be electrically coupled to a wireless power switching control. Additionally, a solar panel may be provided and electrically coupled to the actuator and switching control to supply energy to the actuator and switching control. In an embodiment of the invention the actuator may be of the linear actuation type and may be of a solenoid or hydraulic type of known suitable construction.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

Figure 1:
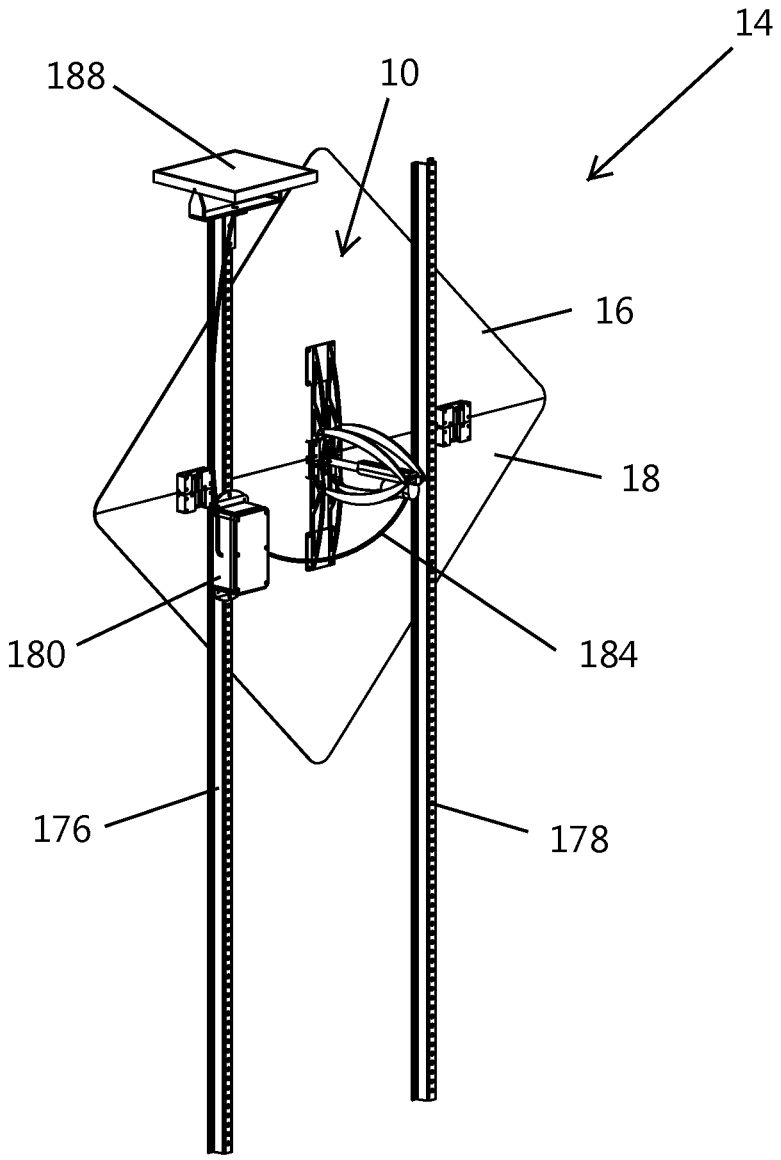
FIG. 1 is a back left perspective view of a remote staked highway road sign apparatus of the present invention shown in an open position.
Figure 2:
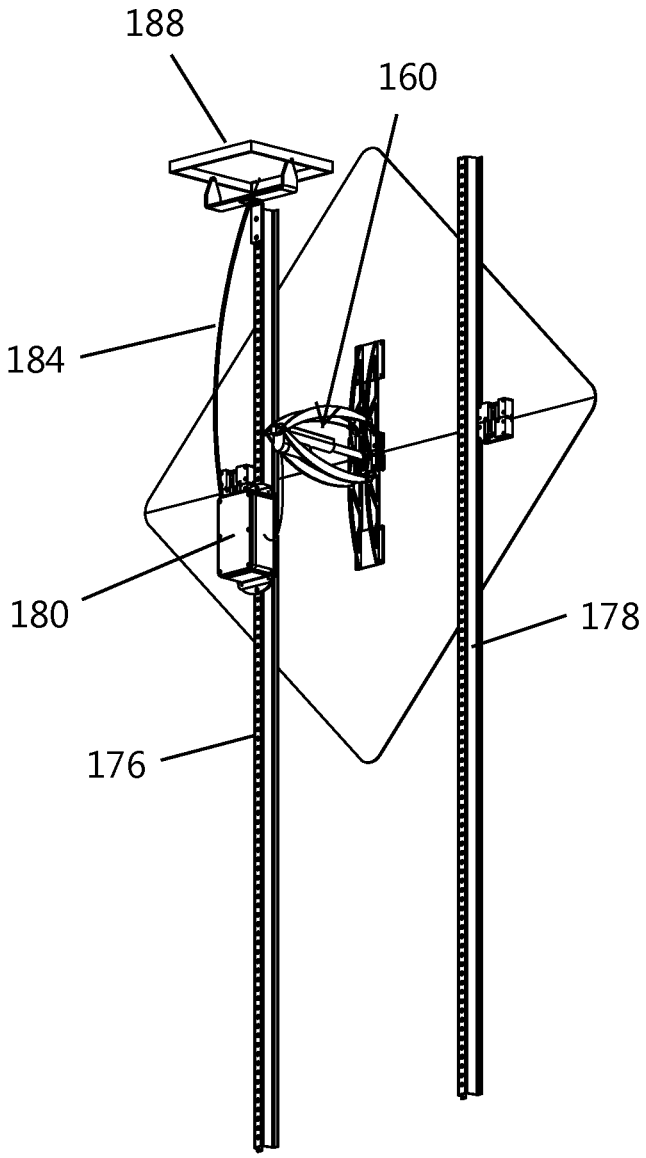
FIG. 2 is a back right perspective view of a remote staked highway road sign apparatus of the type shown in FIG. 1.
Figure 3:
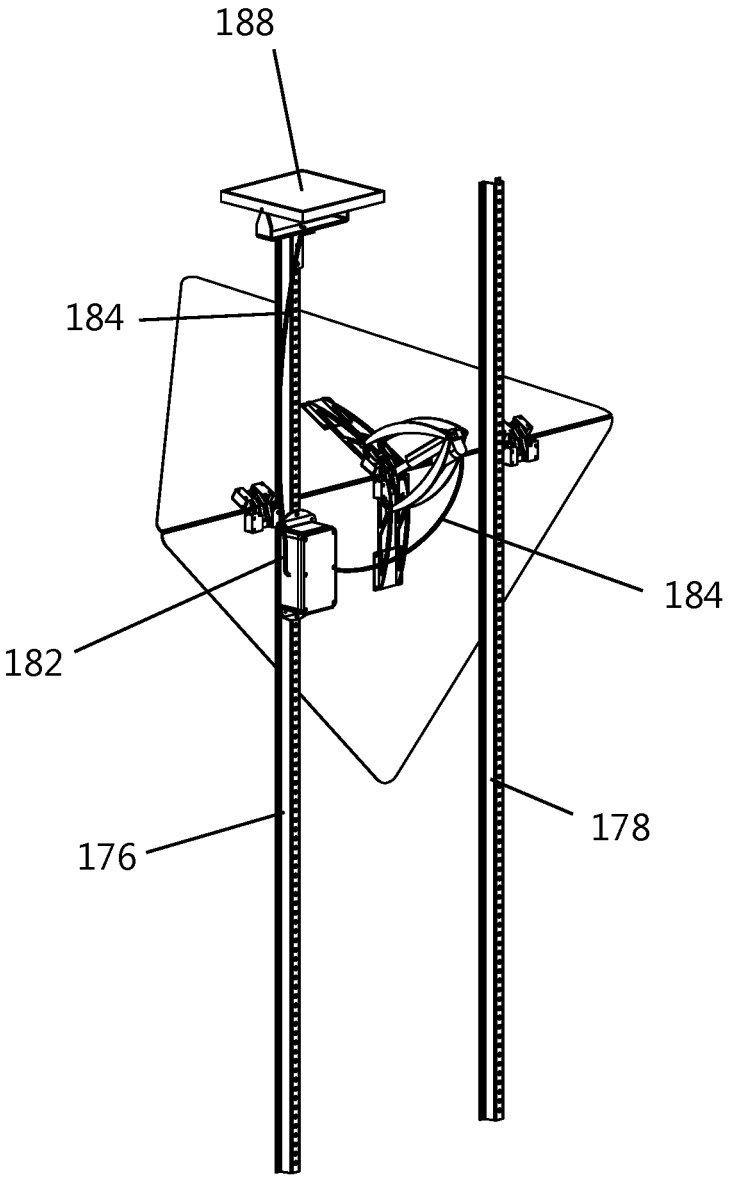
FIG. 3 is a back left perspective view of a remote staked highway road sign apparatus of the present invention shown in a partially closed position.
Figure 4:
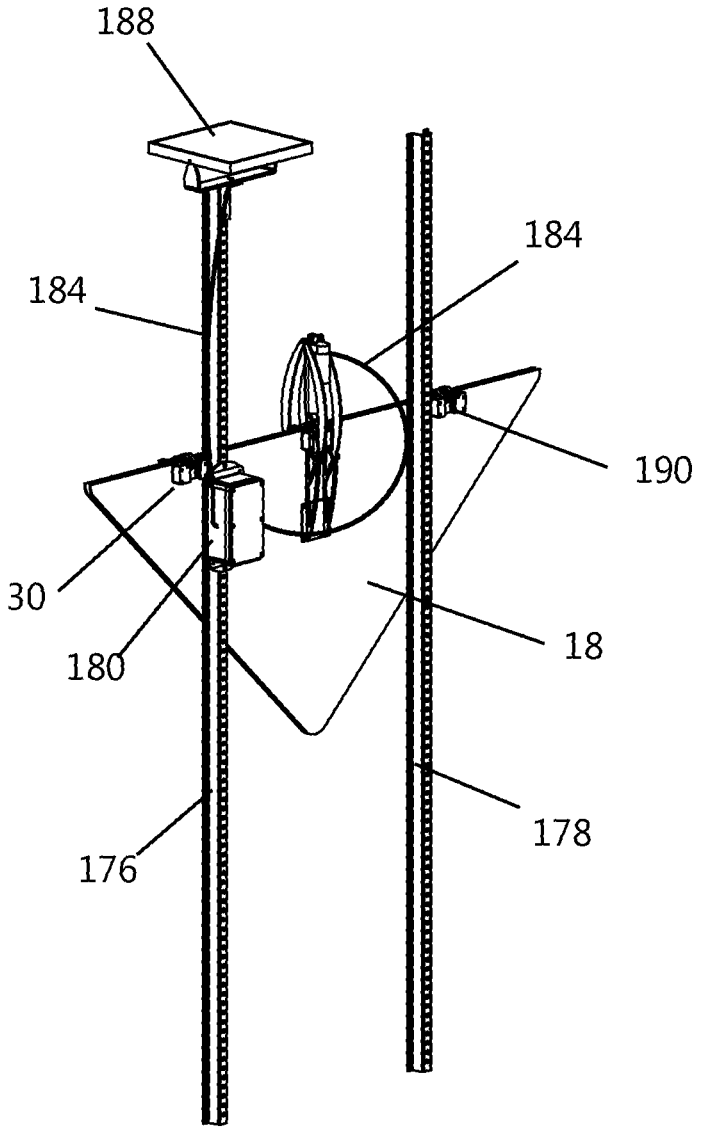
FIG. 4 is a back left perspective view of a remote staked highway road sign apparatus of the present invention shown in a closed position.
Figure 5:
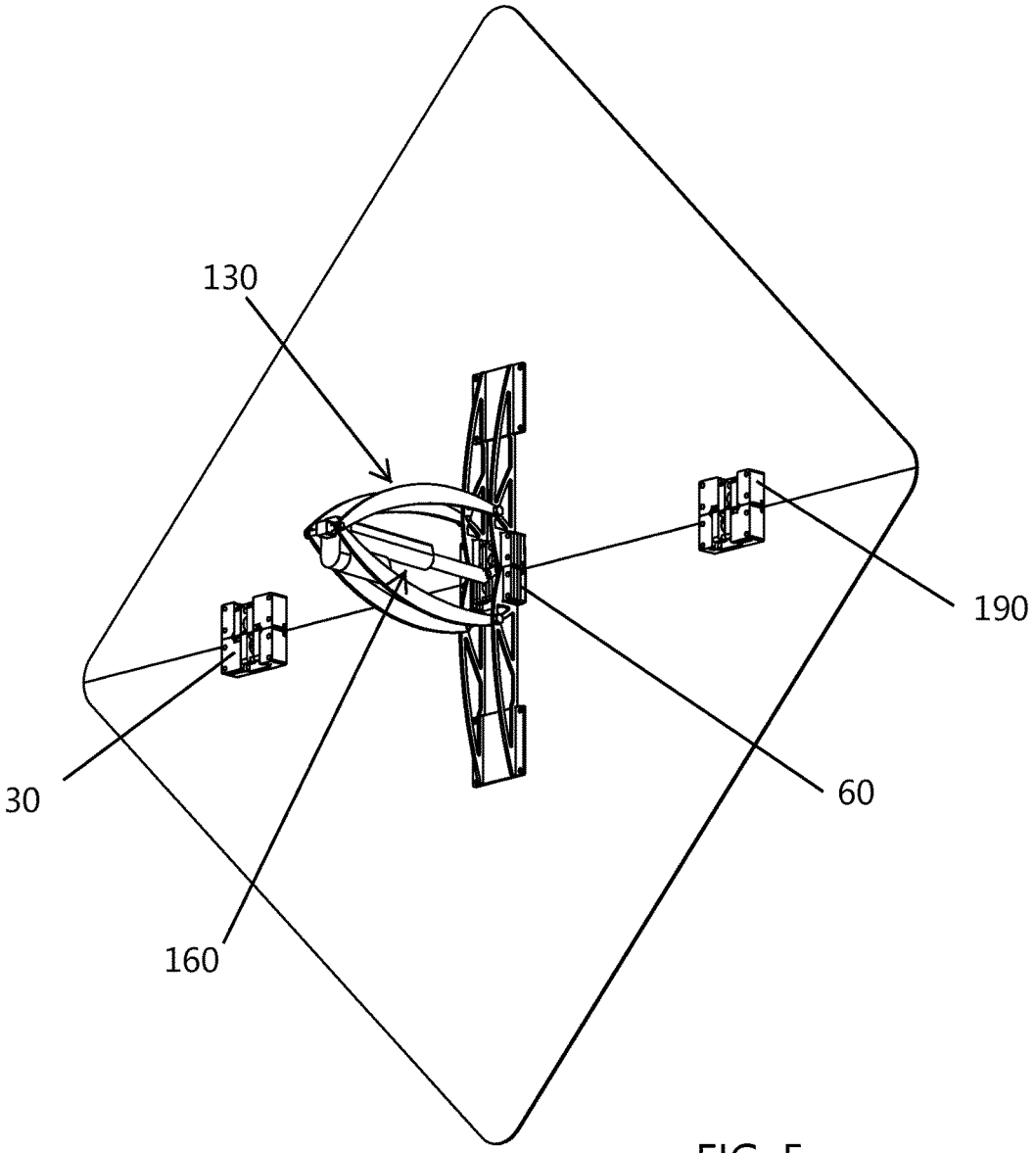
FIG. 5 is a back right perspective view of an embodiment of a highway road sign apparatus of the present invention shown in an open position.
Figure 6:
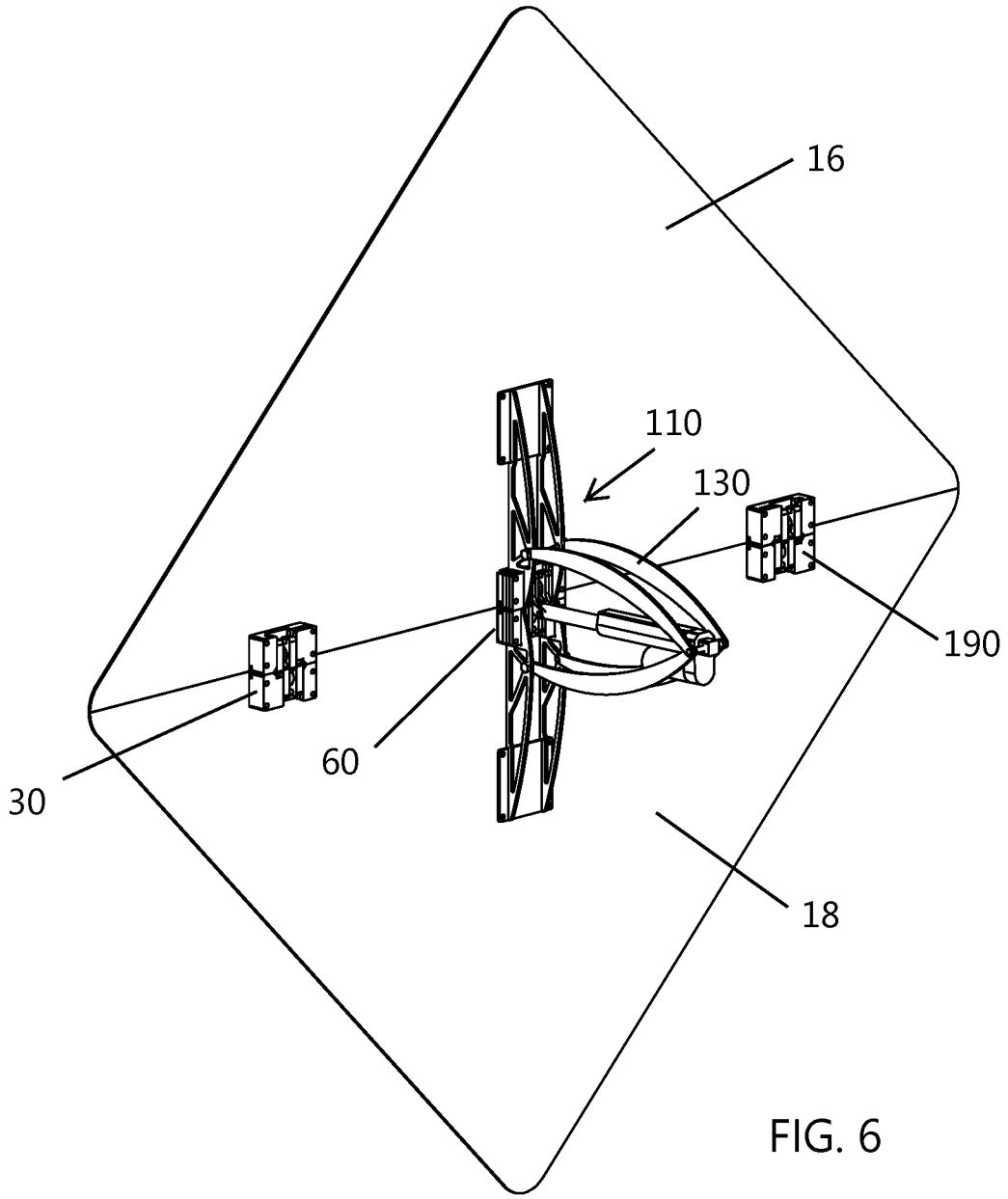
FIG. 6 is a back left perspective view of an embodiment of a highway road sign apparatus of the present invention shown in an open position.
Figure 7:
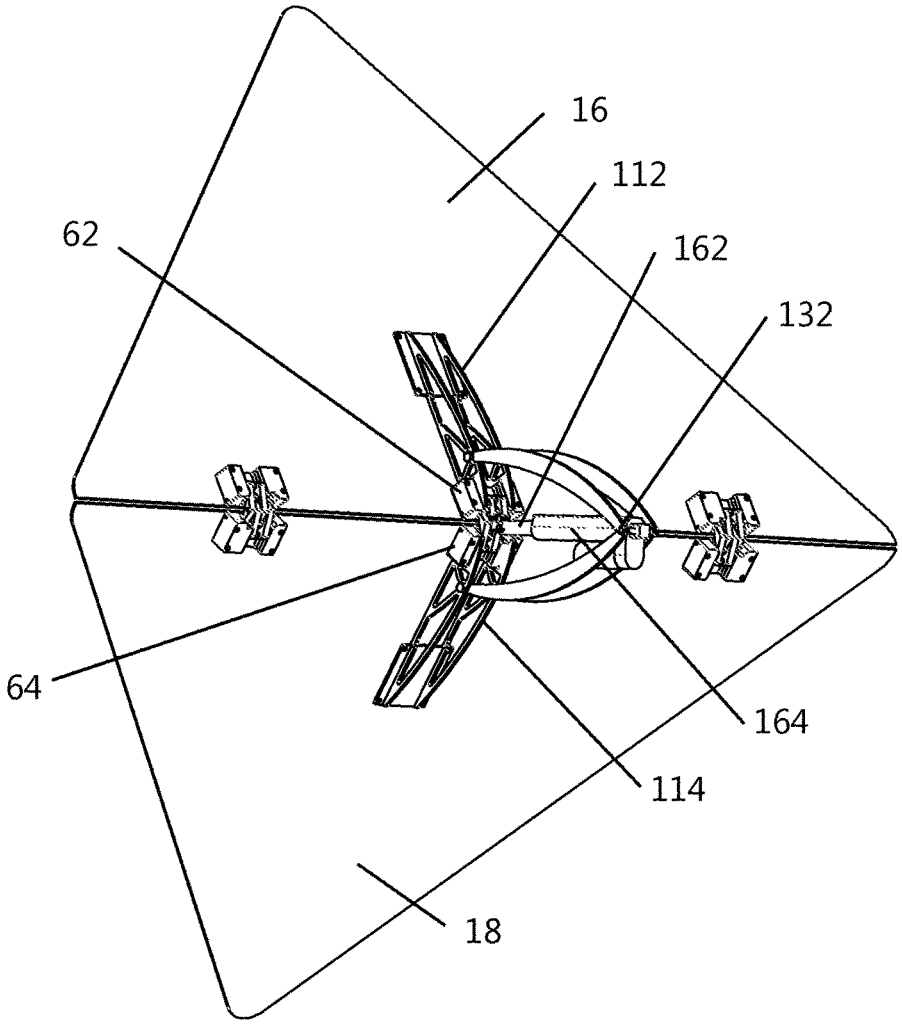
FIG. 7 is a back left perspective view of an embodiment of a highway road sign apparatus of the present invention shown in a partially open position.
Figure 8:
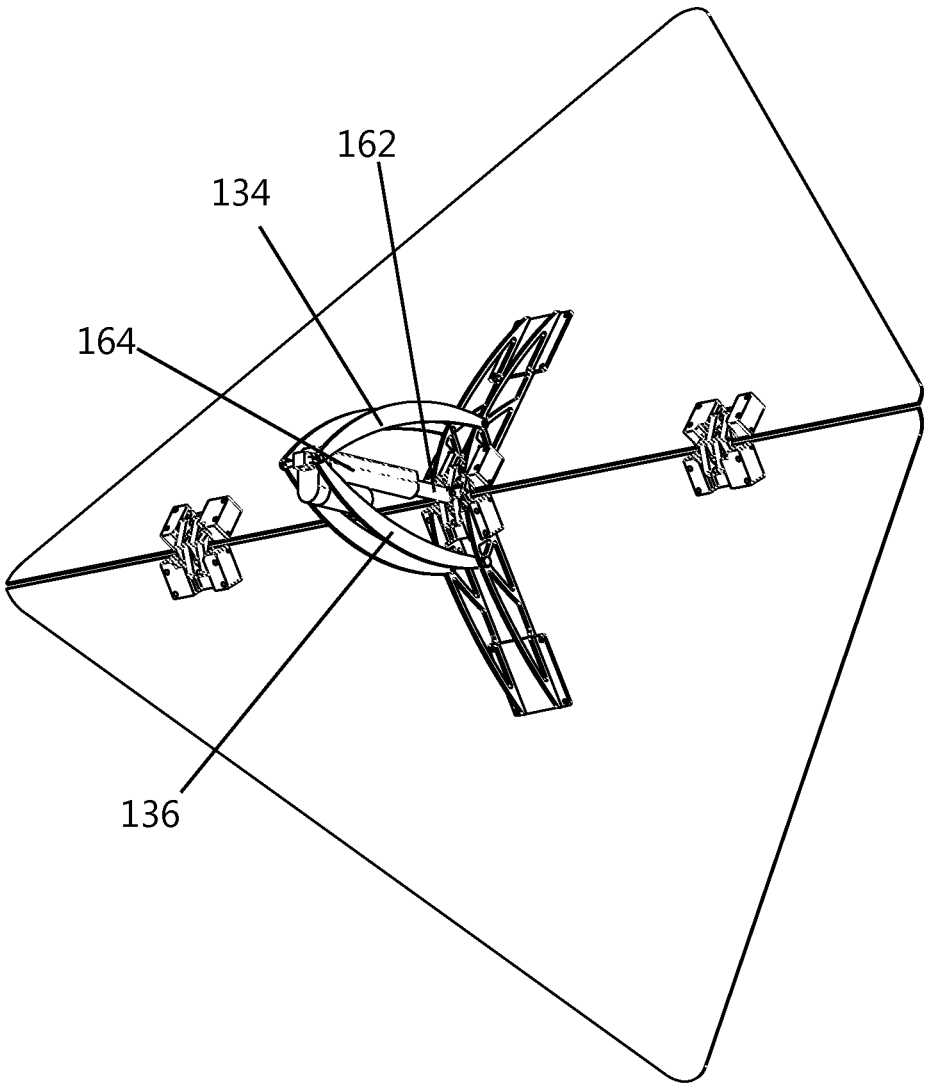
FIG. 8 is a back right perspective view of an embodiment of a highway road sign apparatus of the present invention shown in a partially open position.
Figure 9:
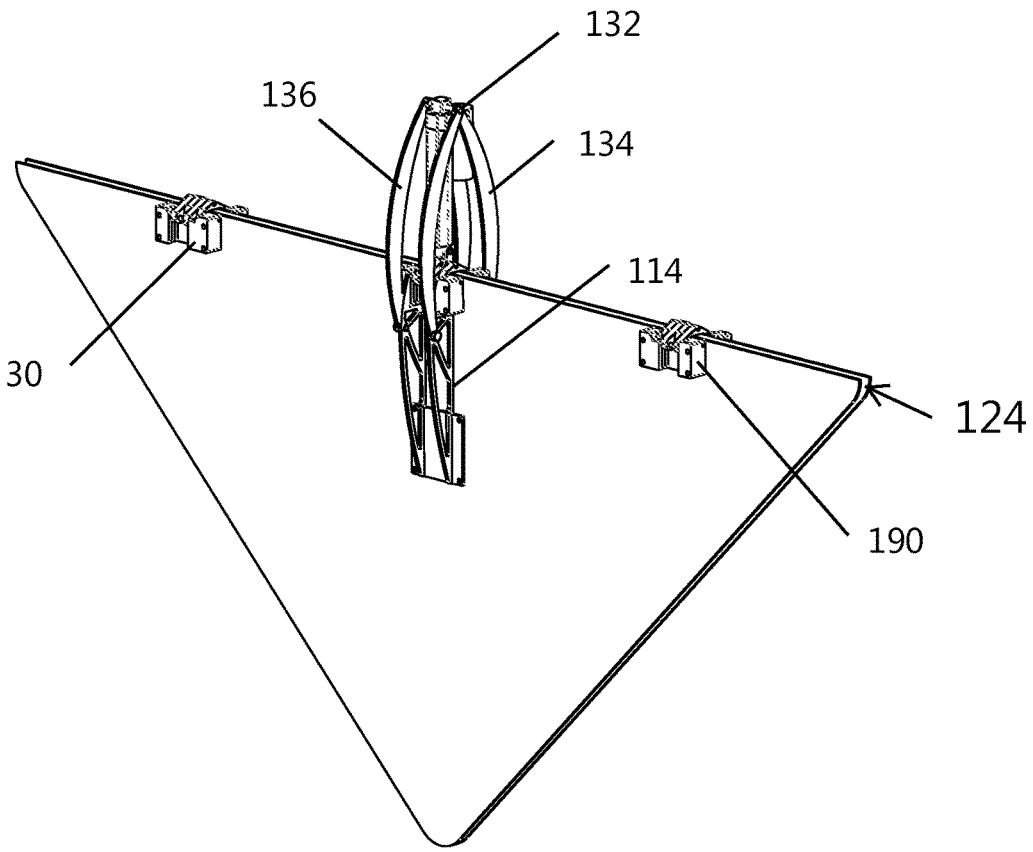
FIG. 9 is a front perspective view of an embodiment of a highway road sign apparatus of the present invention shown in a closed open position.
Figure 10:
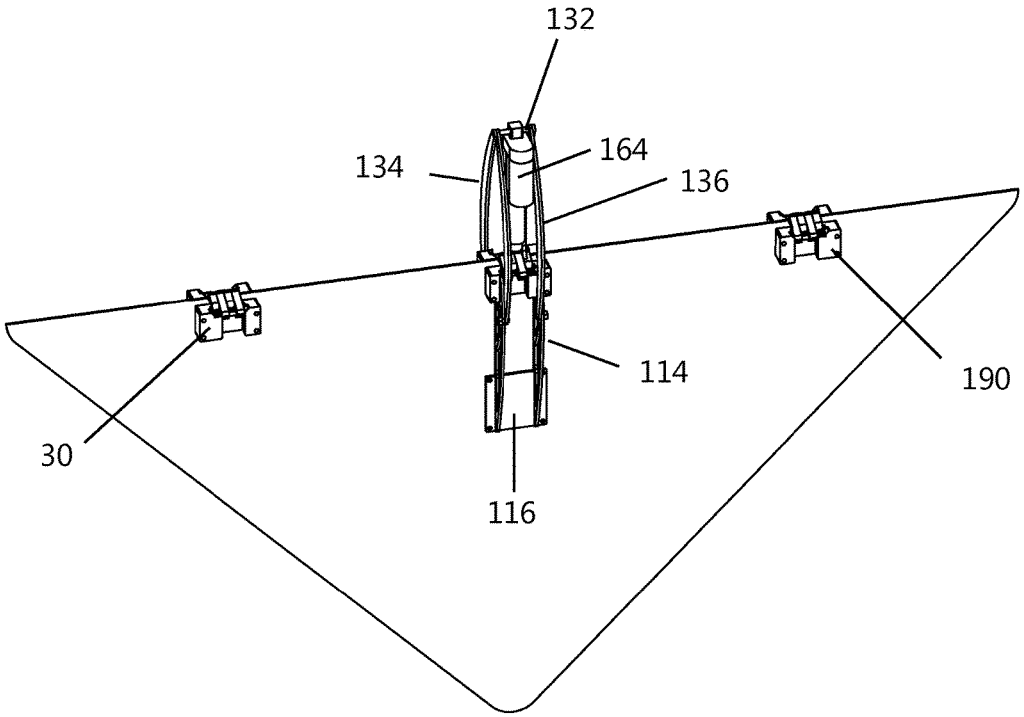
FIG. 10 is a back perspective view of an embodiment of a highway road sign apparatus of the present invention shown in a closed position.
Figure 11:
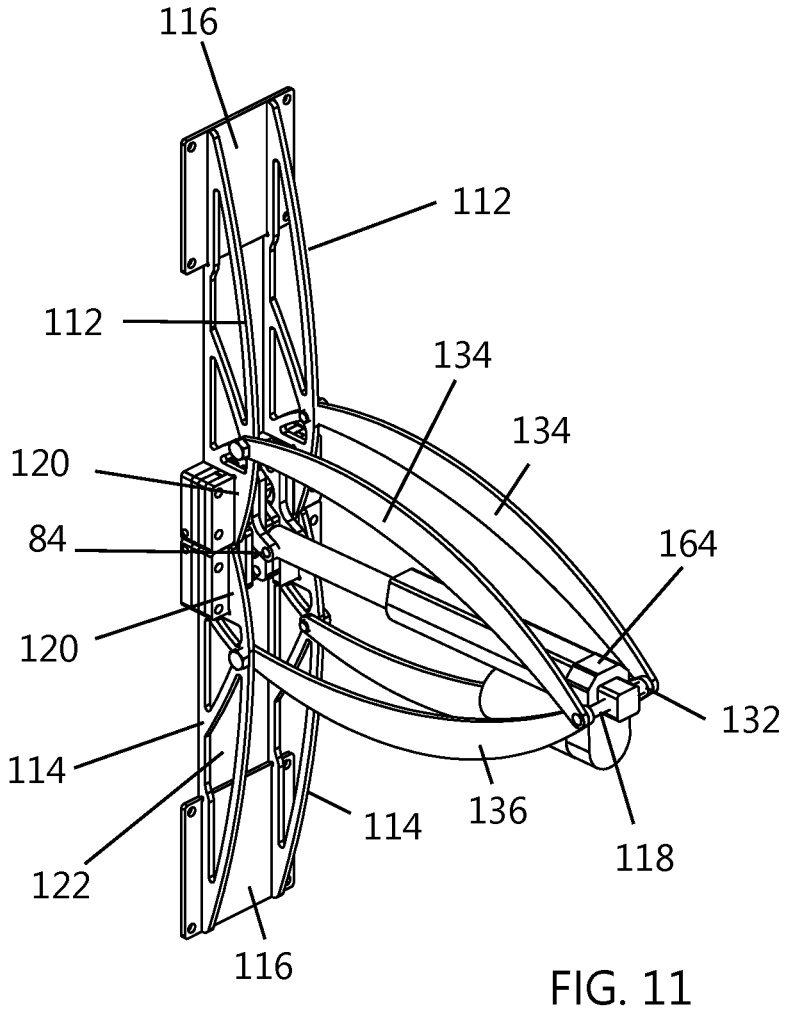
FIG. 11 is a back perspective view of an embodiment of a middle hinge, braces, support member, and actuator of a highway road sign of the present invention shown in an open position.
Figure 12:
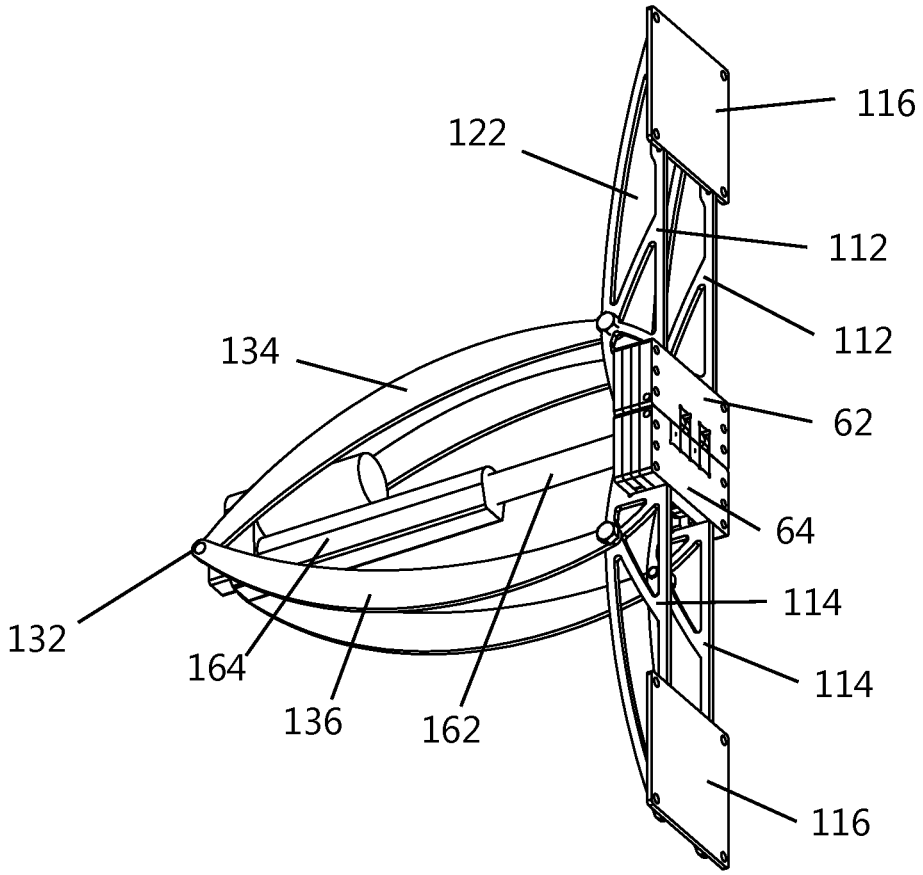
FIG. 12 is a front perspective view of an embodiment of a middle hinge, braces, support member, and actuator of a highway road sign of the present invention shown in an open position.
Figure 13:
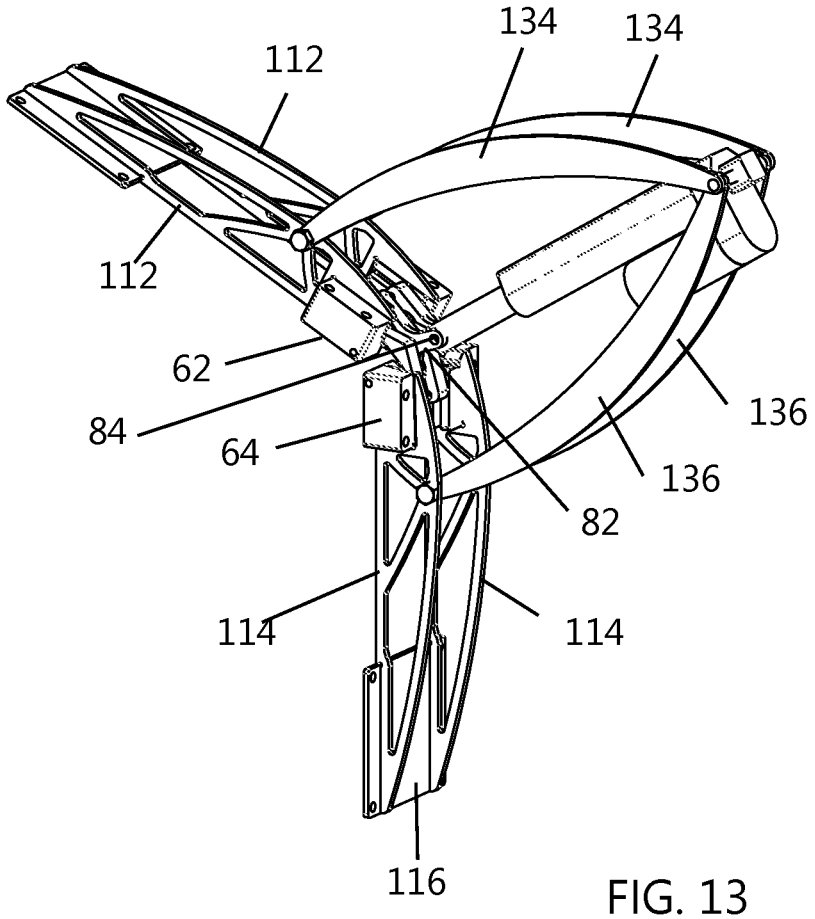
FIG. 13 is a back left perspective view of an embodiment of a middle hinge, braces, support member, and actuator of a highway road sign of the present invention shown in a partially open position.
Figure 14:
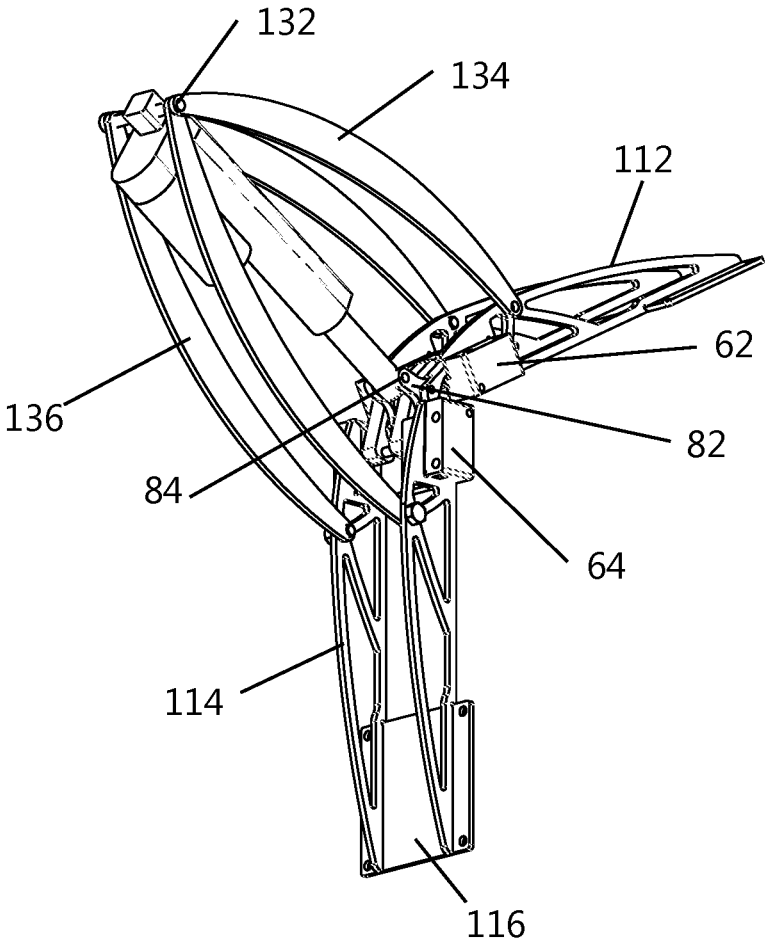
FIG. 14 is a back right perspective view of an embodiment of a middle hinge, braces, support member, and actuator of a highway road sign of the present invention shown in a partially open position.
Figure 15:
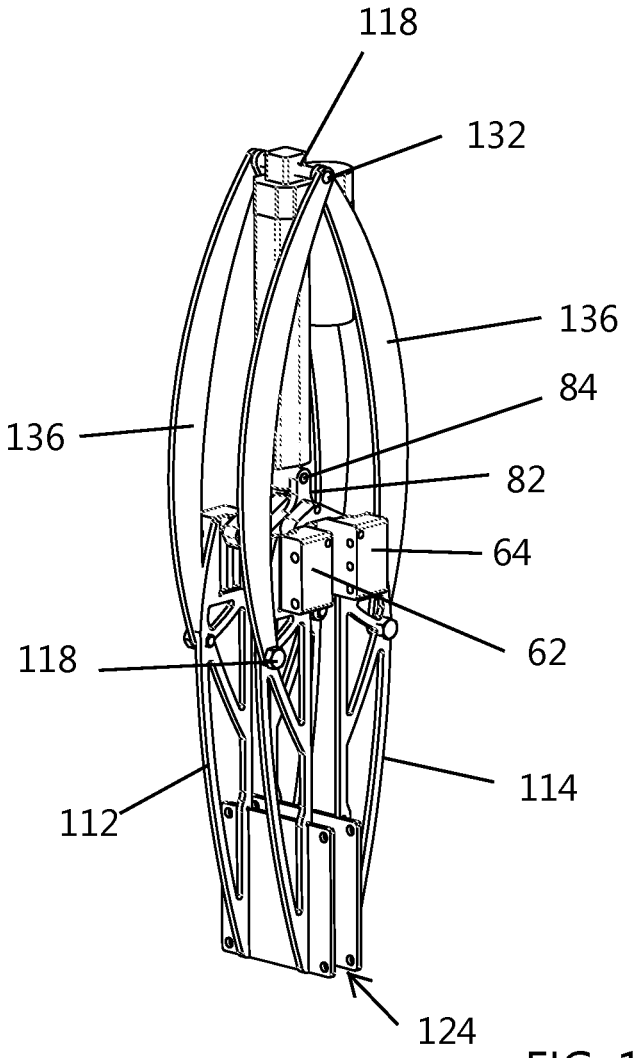
FIG. 15 is a front upper perspective view of an embodiment of a middle hinge, braces, support member, and actuator of a highway road sign of the present invention shown in a closed position.
Figure 16:
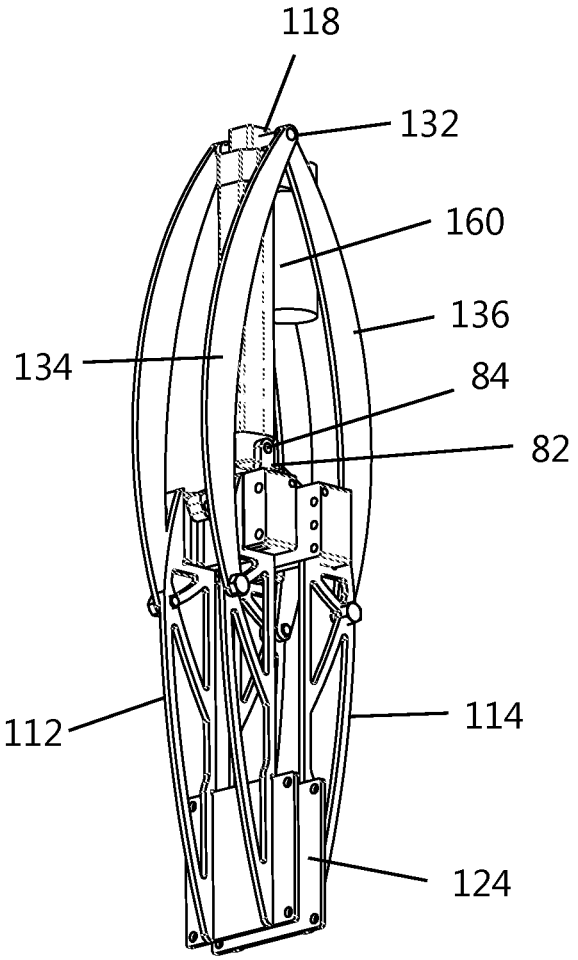
FIG. 16 is a front lower perspective view of an embodiment of a middle hinge, braces, support member, and actuator of a highway road sign of the present invention shown in a closed position.

The following description provides detail of various embodiments of the invention, one or more examples of which are set forth below. Each of these embodiments are provided by way of explanation of the invention, and not intended to be a limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

The apparatus 10 of the present invention is particularly well suited for remote opening and closing the first and second halves 16 and 18 of a two piece work zone roadway sign 14. With reference to the Figures, various embodiments according to aspects of the invention will be described in greater detail. With reference to FIGS. 1-5, a work zone roadway sign assembly is shown removed and suspended above the ground. The sign 14 includes a first half 16 and second half 18 coupled together by first hinge 30, second hinge 60 and third hinge 190. The apparatus for folding the sign 14 generally includes at least one hinge 60, bracing 110, an articulating support member 130, and an actuator 160. Additional hinges 30 and 190 may be aligned on either side of hinge 60 and each hinge includes two hinge mounts wherein each hinge mount is attached to a corresponding first and second half 16 and 18 of the roadway sign 14. The sign 14 may be mounted to stakes 176 and 178 that are buried or driven into the ground. The apparatus 10 may further include a remote controlled power switch control 180 and solar panel 188 of known suitable construction coupled to the actuator 160 with electrical conduits 184. The solar panel is attached to stake 176 and the remote wifi control 180 is coupled to the lower half 18 of the sign 14. The wireless power switch control or remote wifi 180 may further include an antenna 182. Without limitation intended, the wireless control may include wi-fi, z-wave or Bluetooth systems having hand held, key fob or switch controllers. Operating system apps may also be utilized to create additional functionality for the controller.

Referring to FIGS. 6-10, bracing 110 includes a first brace 112 fixed to the first half 16 of the sign 14 and is further engaged to a first hinge mount 62 of the second hinge 60. Similarly, bracing 110 includes a second brace 114 fixed to the second half 18 of the sign 14 and the second brace 114 is further engaged to the second hinge mount 64 of the second hinge 60. Articulating support member 130 couples together the first brace 112 and second brace 114. The support member 130 articulates at a mid-joint 132 and has a first end 134 pivotally attached to the first brace 112 and a second end 136 pivotally attached to the second brace 114. The actuator 160 has a first end 162 pivotally coupled to the hinge 60 and has a second extendable end 164 pivotally coupled to the articulating support member 130.

Those skilled in the art will appreciate that the actuator 160 may be of an integrated electric actuator of known suitable construction that combines servomotor, digital drive, linear controller and actuator in a compact unit, such as those available from Motion Control Products and Tolmatic. In use, when the second end 164 extends out of the main body, the two halves of the sign pivot closed and then the second end 164 draws into the main body the two halves of the sign pivot open.

FIGS. 11-16 also illustrates the attachment, coupling and actuation of the hinge 60, bracing 110, articulating support member 130 and actuator 160. The first ends 134 of support member are pivotally attached with pivot pins 118 to the first braces 112 and the second ends 136 of support member 130 are pivotally attached with pivot pins 118 to the second brace 114. A pivot pin 118 couples the first and second ends 134 and 136 of the support members to an end of the second extendable end 164 of the actuator 160 at a mid-joint 132. Sign mounting pads 116 couple free ends of each brace member to each corresponding half of the sign. A flange of the each brace member 112 and 114 extends over the top of corresponding hinge mounts 62 and 64 to provide additional stability and continuity between the sign halves 16 and 18, the braces 112 and 114 and the articulating support member 130. Further, the pads 116 and flanges 120 increase rigidity and reduce the potential of the sign twisting when subjected to cross winds. The reliefs or cutouts 122 in the bracing 112 and 114 further reduce resistance to a cross wind. The pivot attachment of the first end 134 and second end 136 may be modified to couple directly to the respective hinge mounts, however, coupling to the bracing is affective. The hinge 60 includes features that allow the edge of the two signs to align adjacent and with minimal gap when the sign is in the open position and allows a gap 124 between the signs when in the closed folded position (see, for example, FIG. 15).

Figure 17:
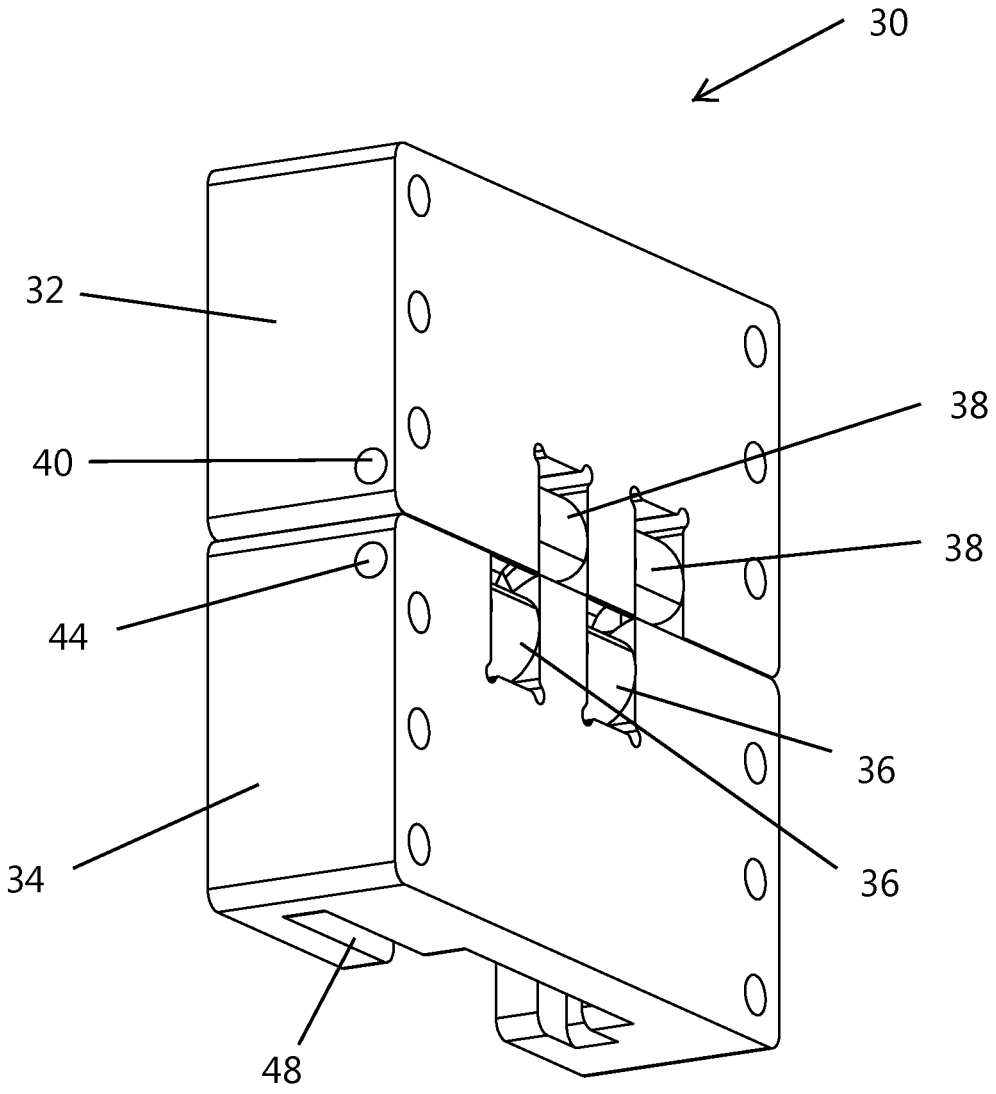
FIG. 17 is a front lower perspective view of an embodiment of a hinge of a highway road sign of the present invention shown in an open position.
Figure 18:
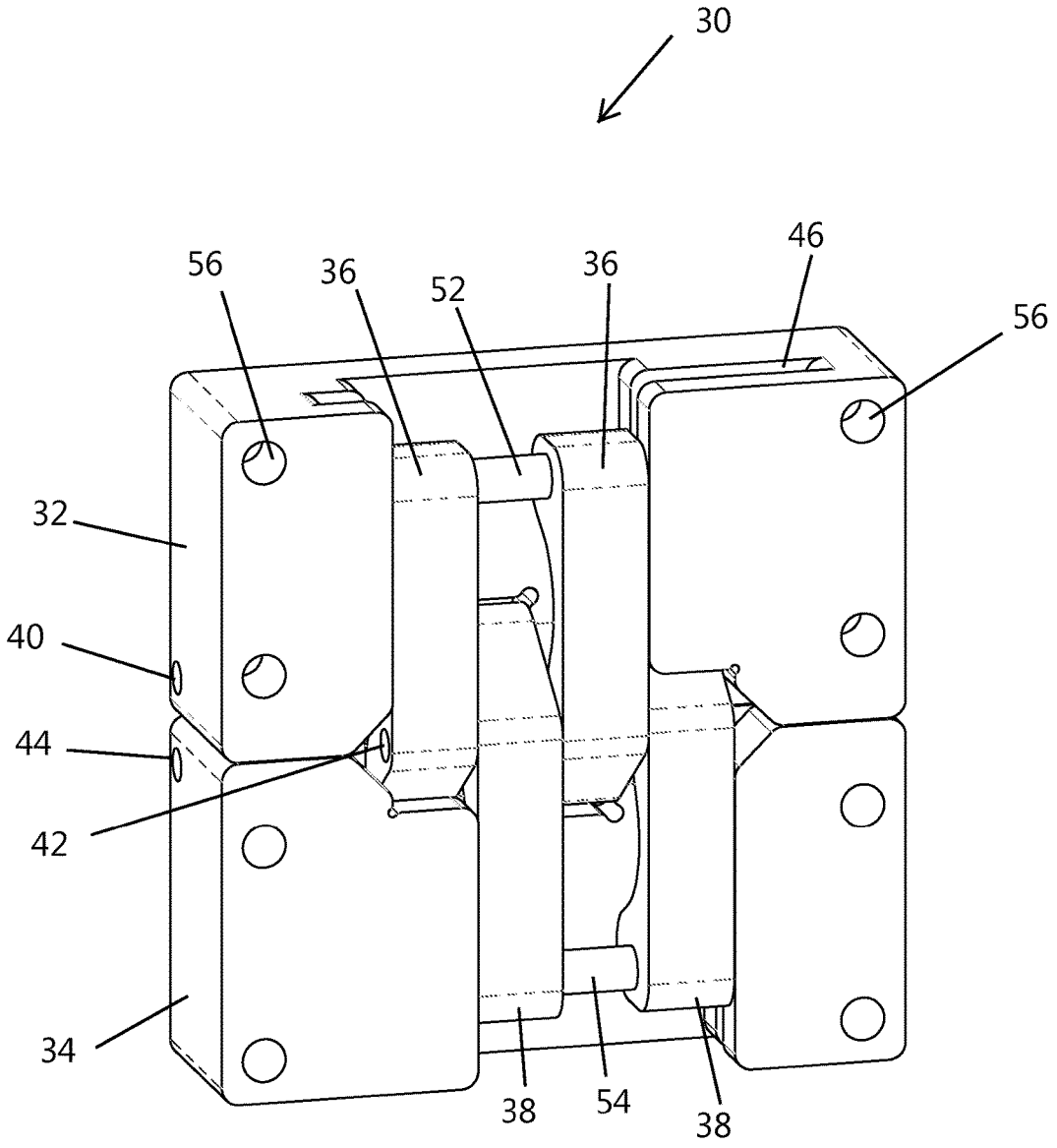
FIG. 18 is a back perspective view of an embodiment of a hinge of a highway road sign of the present invention shown in an open position.
Figure 19:
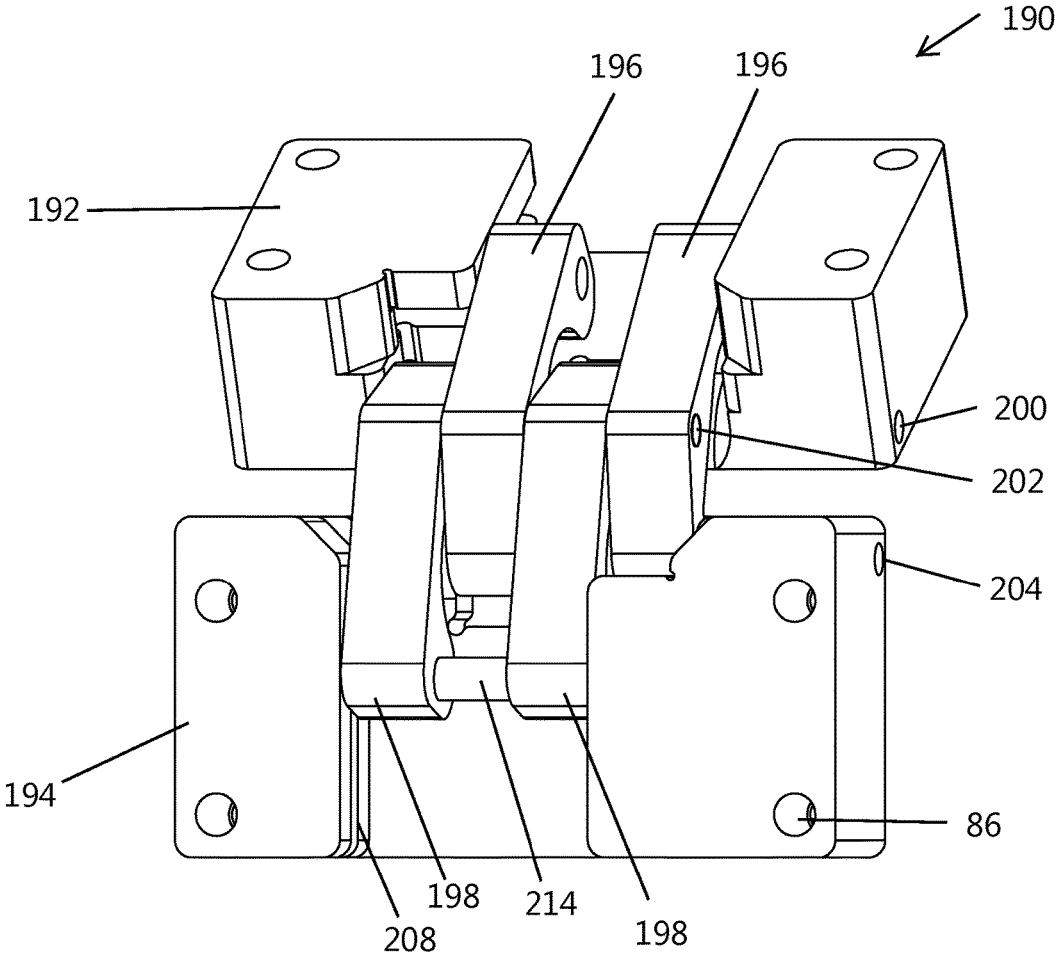
FIG. 19 is a back perspective view of an embodiment of a hinge of a highway road sign of the present invention shown in a partially closed position and having a pin removed.
Figure 20:
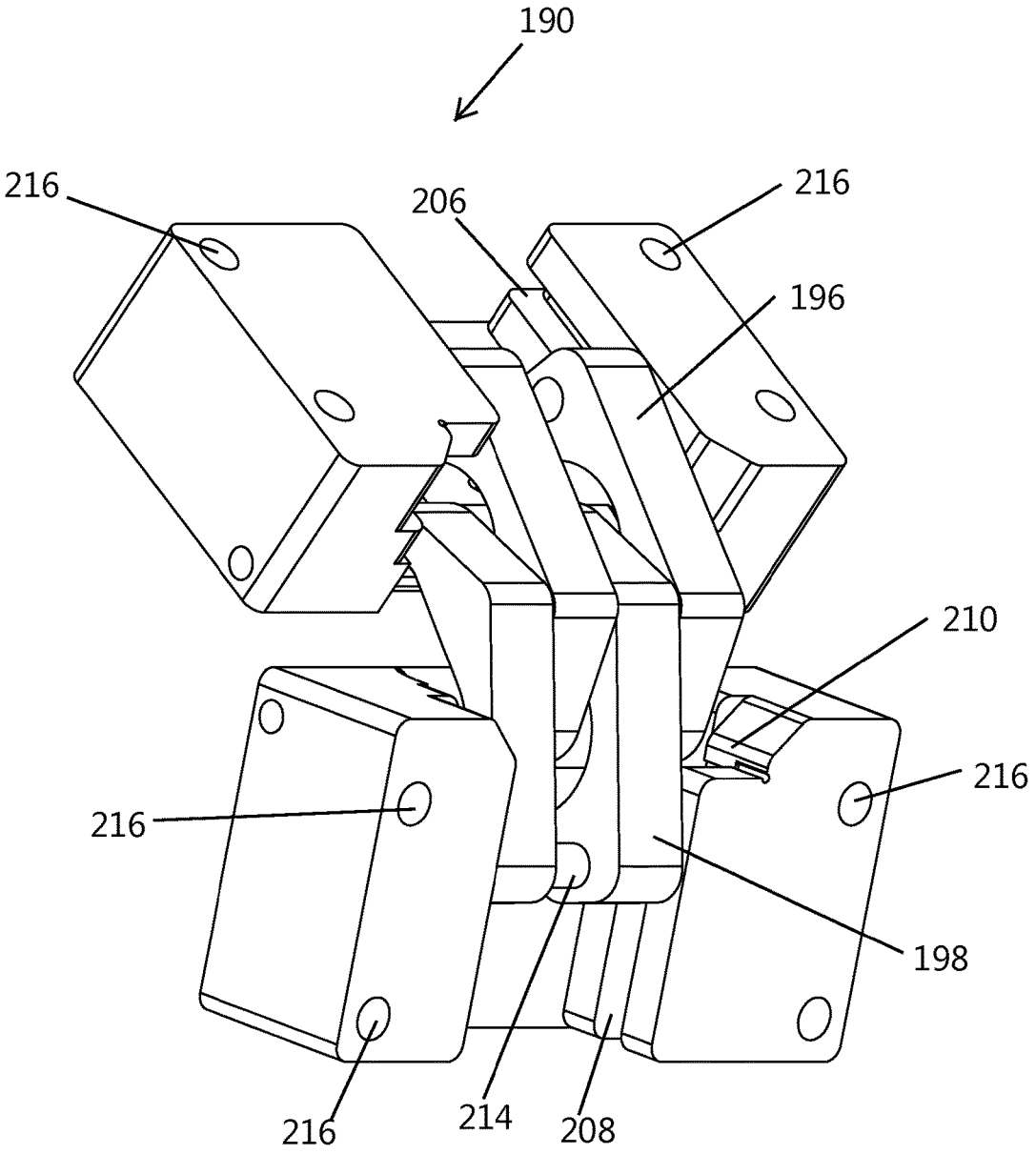
FIG. 20 is a back left perspective view of an embodiment of a hinge of a highway road sign of the present invention shown in a partially closed position and having a pin removed.
Figure 21:
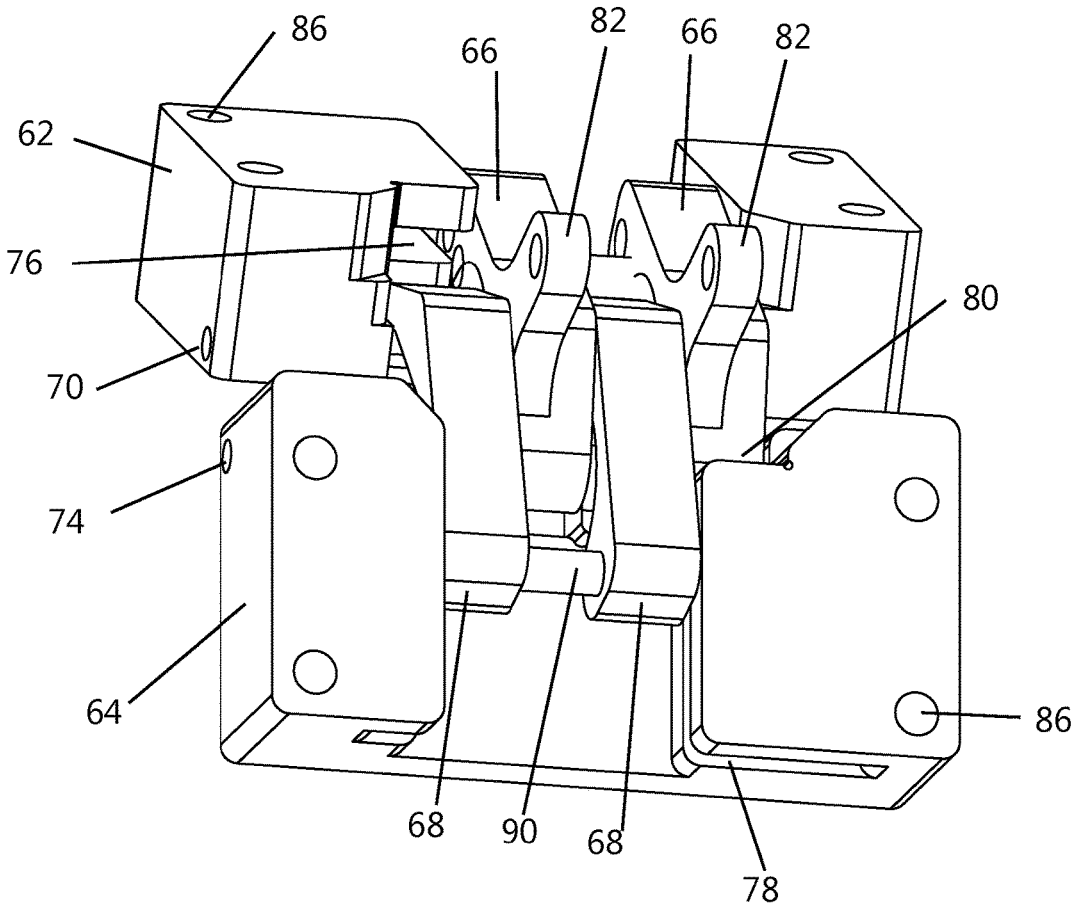
FIG. 21 is a back perspective view of an embodiment of a hinge of a highway road sign of the present invention shown in a partially closed position.
Figure 22:
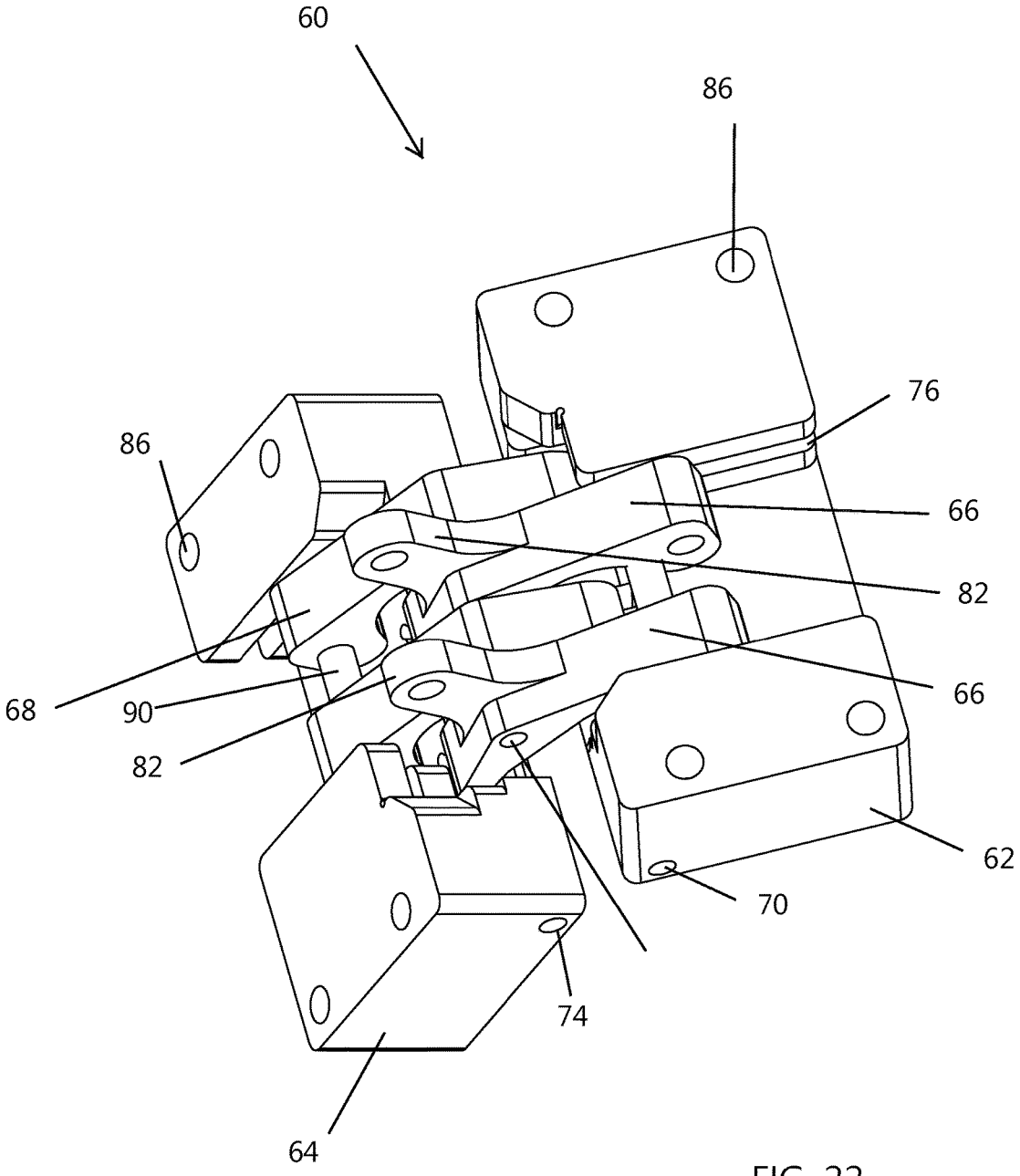
FIG. 22 is a top perspective view of an embodiment of a hinge of a highway road sign of the present invention shown in a partially closed position.
Figure 23:
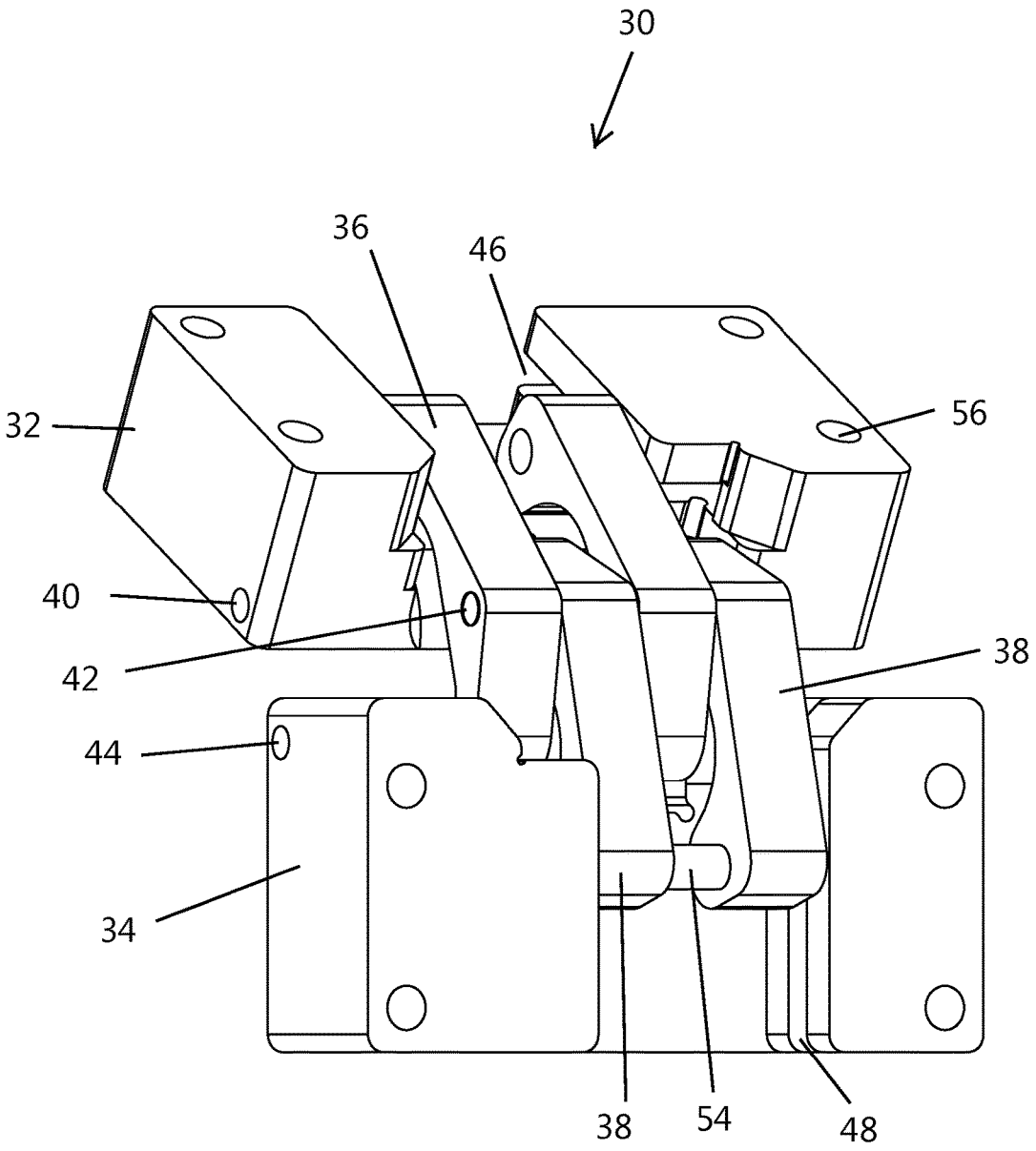
FIG. 23 is a back perspective view of an embodiment of a hinge of a highway road sign of the present invention shown in a partially open position.
Figure 24:
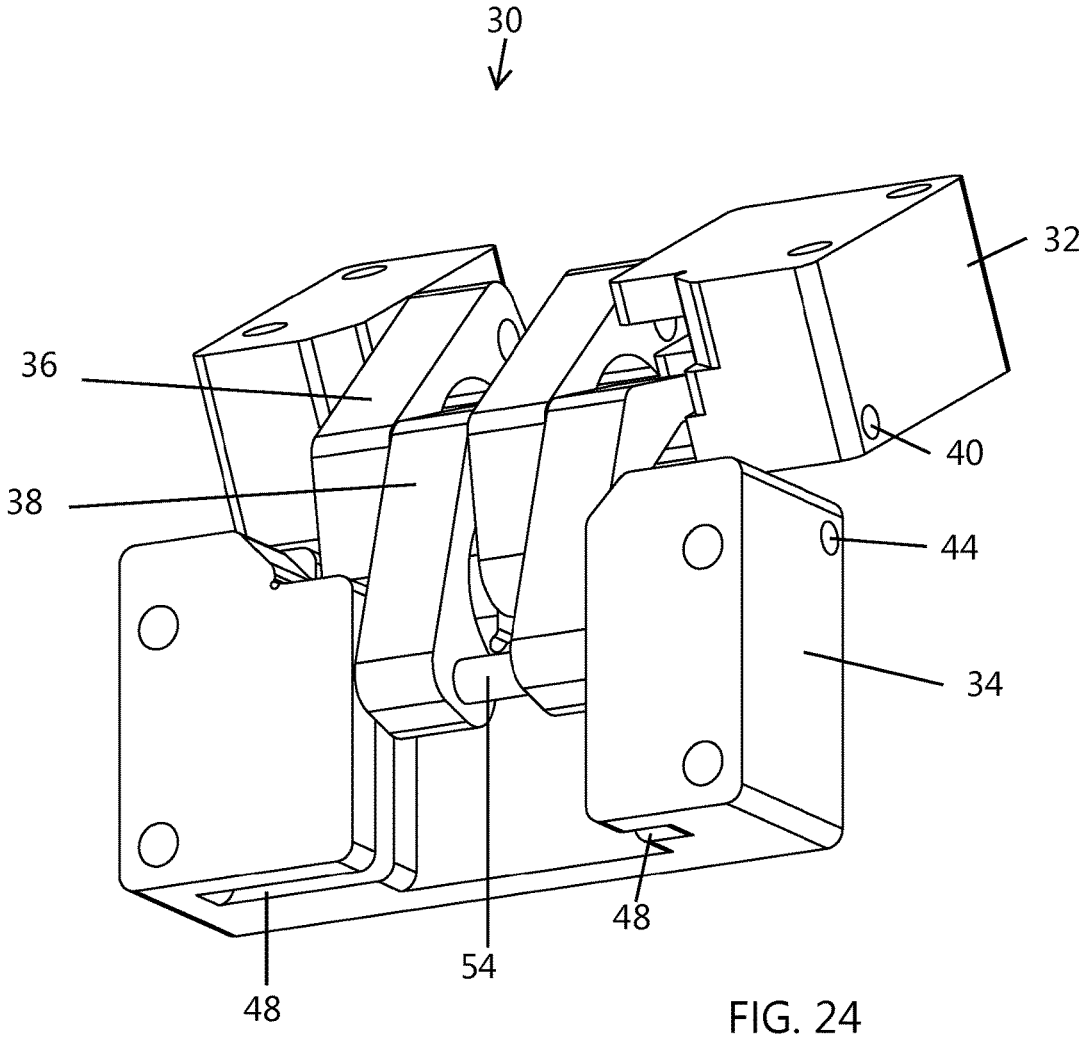
FIG. 24 is a back perspective view of an embodiment of a hinge of a highway road sign of the present invention shown in a partially open position.
Figure 25:
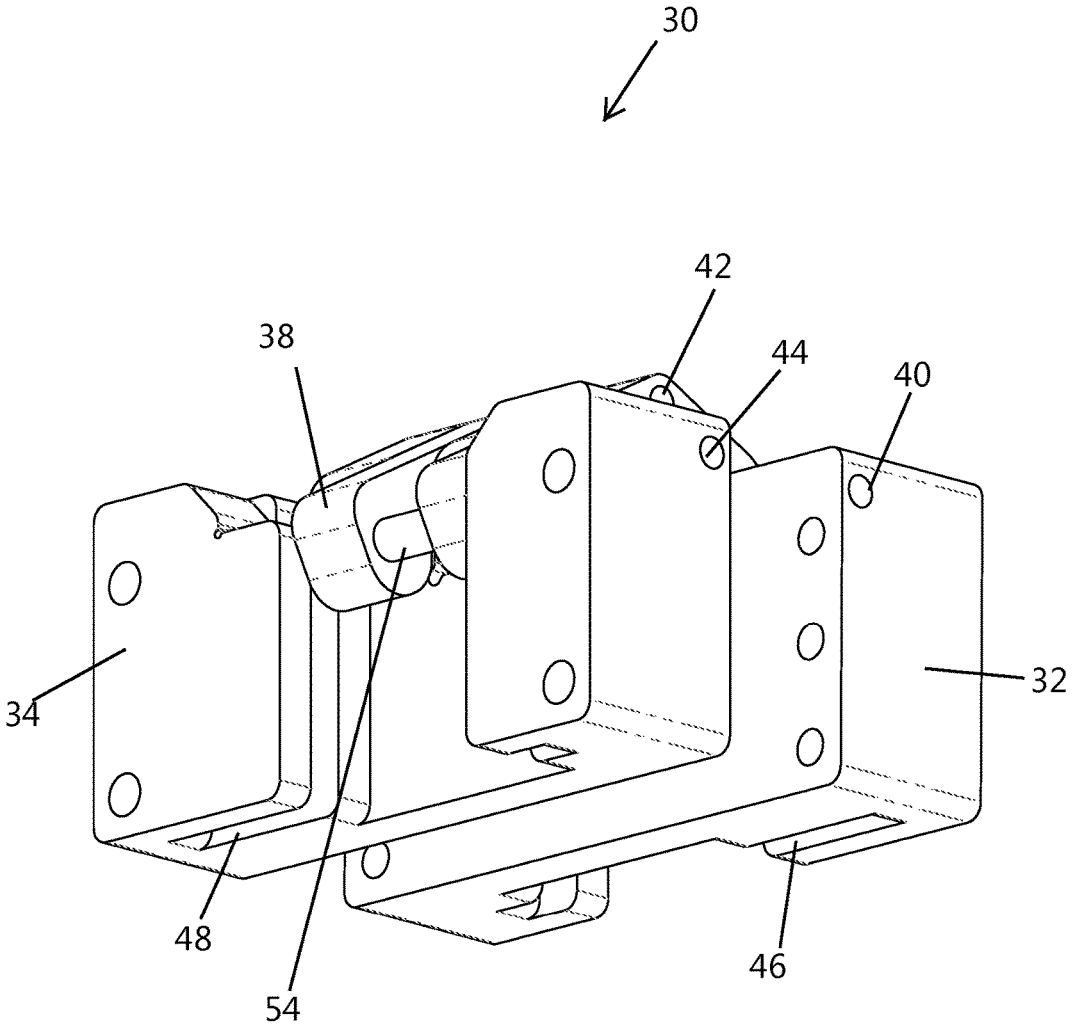
FIG. 25 is a front left perspective view of an embodiment of a hinge of a highway road sign of the present invention shown in a closed position.
Figure 26:
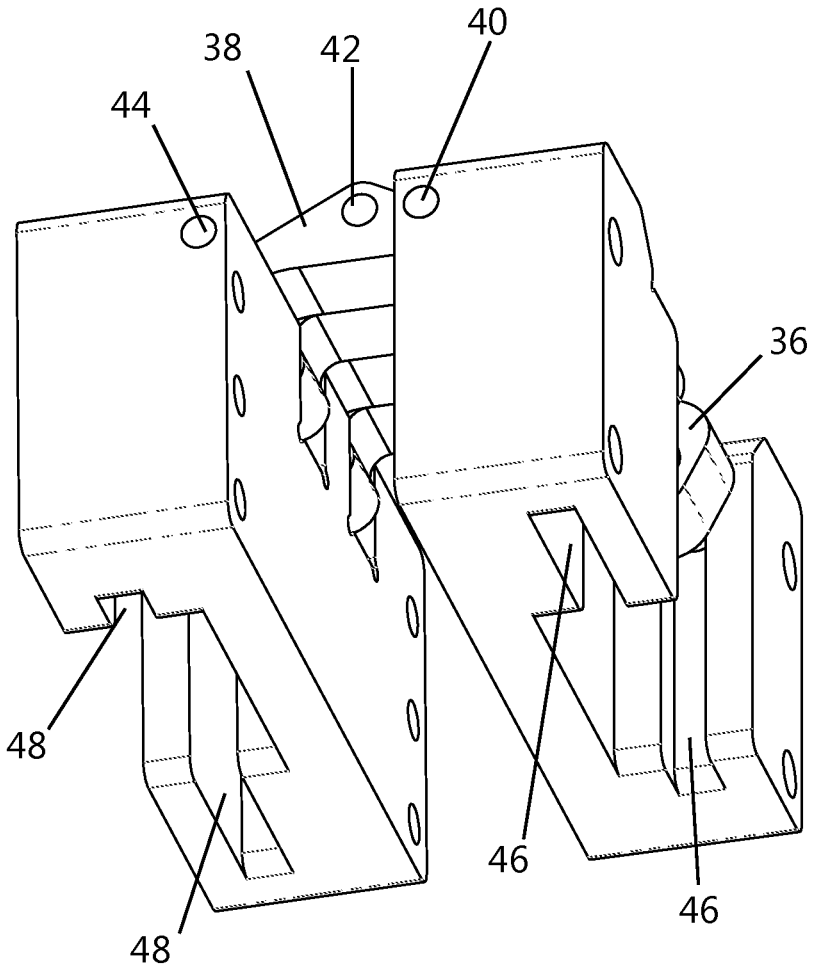
FIG. 26 is a bottom perspective view of an embodiment of a hinge of a highway road sign of the present invention shown in a closed position.
Figure 27:
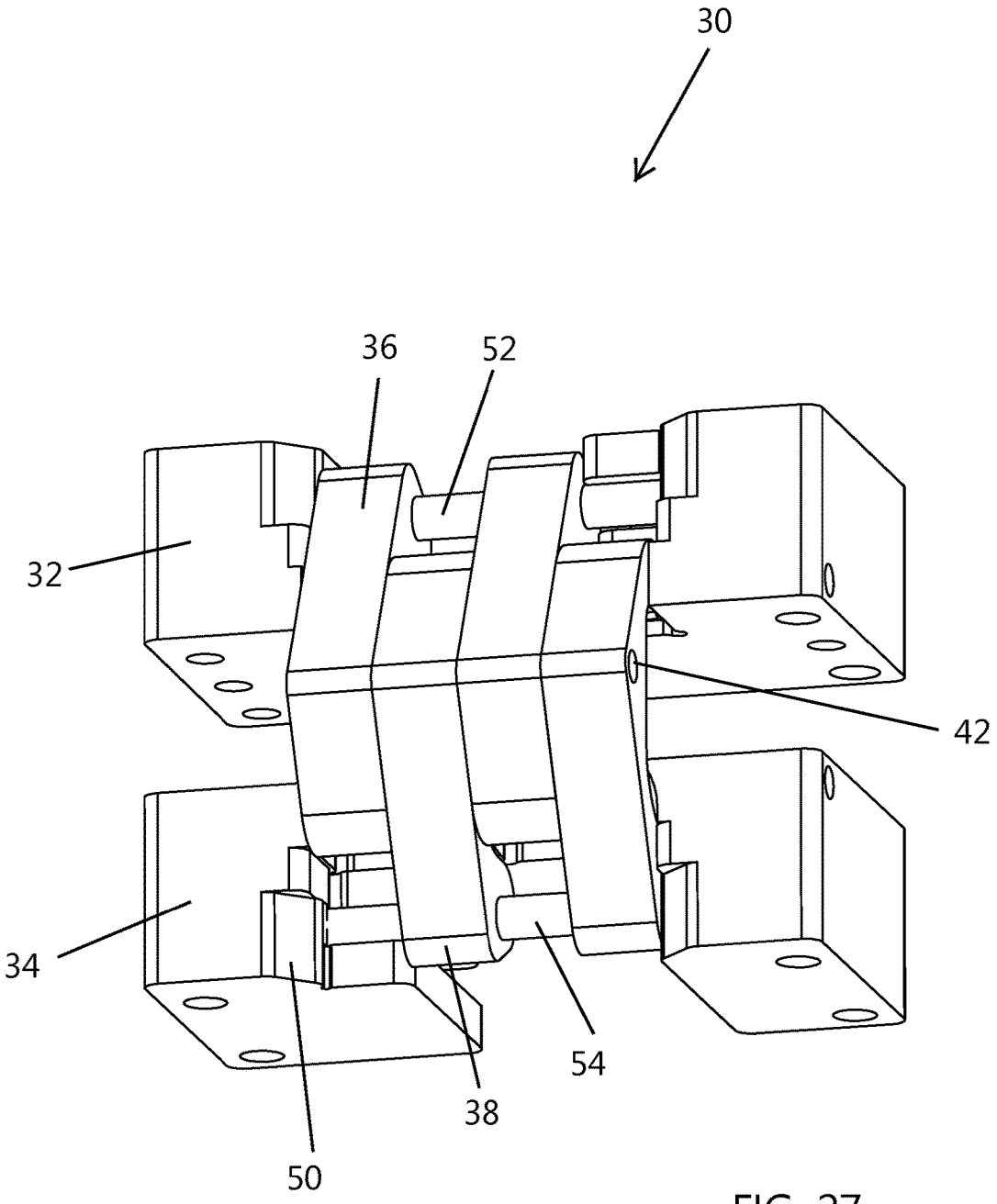
FIG. 27 is a top perspective view of an embodiment of a hinge of a highway road sign of the present invention shown in a closed position.
Figure 28:
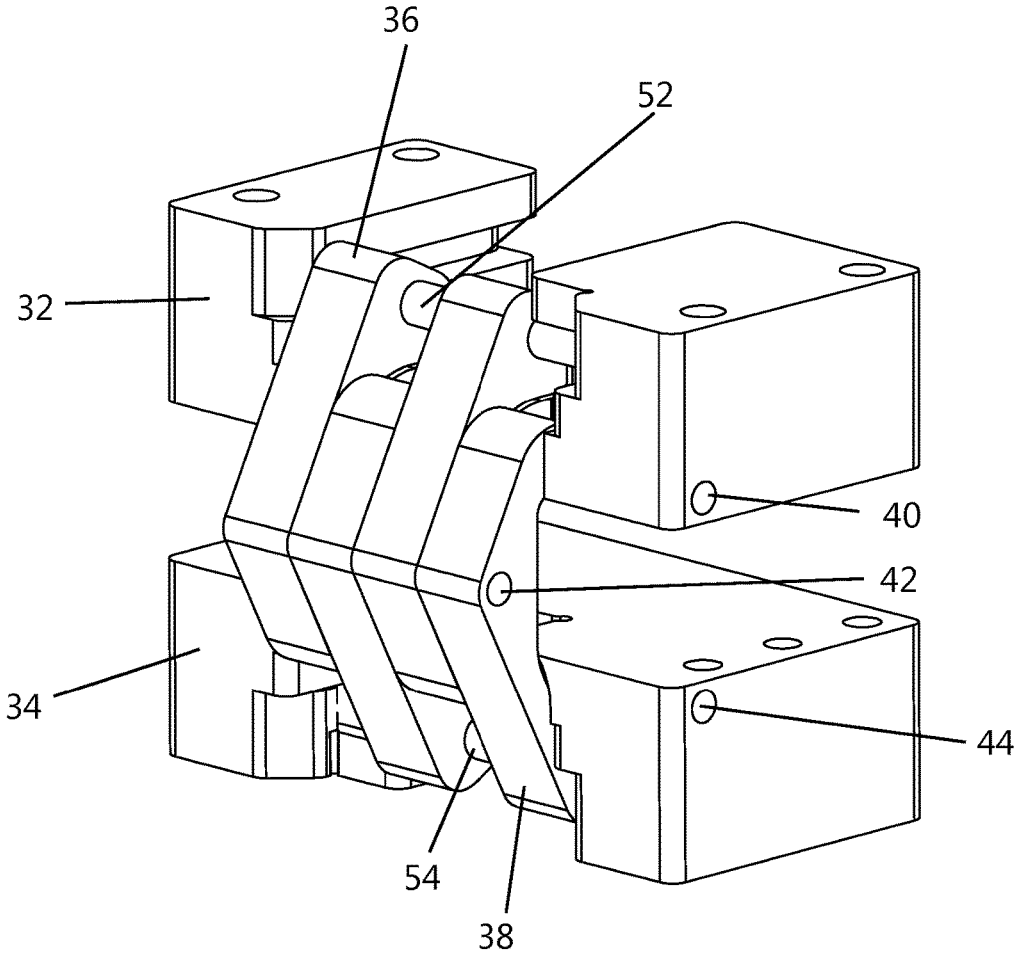
FIG. 28 is a top side perspective view of an embodiment of a hinge of a highway road sign of the present invention shown in a closed position.

FIGS. 17-28 illustrates various embodiments of the hinges 30, 60 and 190 in accordance with aspects of the invention. FIGS. 17 and 18 illustrate hinge 30 in the open position. FIGS. 19 through 24 illustrate hinges 30, 60 and 190 in a partially open position and FIGS. 25 through 28 illustrate hinge 190 in the closed position. Hinge 30 includes first hinge mount 32, second hinge mount 34, a top pair of arms 36 and a bottom pair of arms 38. A first end of the top pair of arms 36 is pivotally coupled to the second hinge mount 34 with a bottom pivot pin 44. A second end of the top pair of arms 36 is slidingly coupled to the first hinge mount 32 with a guideway pin 52 that slides in guideways 52 formed in the hinge mount 32. Similarly, a first end of the bottom pair of arms 38 is pivotally coupled to the first hinge mount 32 with a top pivot pin 40. A second end of the bottom pair of arms 38 is slidingly coupled to the second hinge mount 34 with a guideway pin 54 that slides in guideways 48 formed in the hinge mount 34. The pairs of arms 36 and 38 are pivotally coupled together with a middle pivot pin 42. A relief 50 may be formed in the first and second hinge mounts 32 and 34 to allow the hinge mounts to pivot into an open position without the arms binding on the hinge mounts. Holes 56 are formed in the hinge mounts to allow the hinge mounts to be attached to a sign.

Middle hinge 60 includes first hinge mount 62, second hinge mount 64, a top pair of arms 66 and a bottom pair of arms 68. A first end of the top pair of arms 66 is pivotally coupled to the second hinge mount 64 with a bottom pivot pin 74. A second end of the top pair of arms 66 is slidingly coupled to the first hinge mount 62 with a guideway pin 88 that slides in guideways 72 formed in the hinge mount 62. Similarly, a first end of the bottom pair of arms 68 is pivotally coupled to the first hinge mount 62 with a top pivot pin 70. A second end of the bottom pair of arms 68 is slidingly coupled to the second hinge mount 64 with a guideway pin 90 that slides in guideways 78 formed in the hinge mount 64. The pairs of arms 66 and 68 are pivotally coupled together with a middle pivot pin 72. A relief 80 may be formed in the first and second hinge mounts 62 and 64 to allow the hinge mounts to pivot into an open position without the arms binding on the hinge mounts. Holes 86 are formed in the hinge mounts to allow the hinge mounts to be attached to a sign. The actuator pivot pin mount 82 extends form the top arms 66. Those skilled in the art will appreciate that the actuator mounts 82 may be formed and extend from either the top arms 66, bottom arms 68, or a combination of both. Pivot pin 84 couples the actuator mount to the first end 162 of actuator 160 (see, for example, FIG. 11).

Opposing hinge 190 includes first hinge mount 192, second hinge mount 194, a top pair of arms 196 and a bottom pair of arms 198. A first end of the top pair of arms 196 is pivotally coupled to the second hinge mount 194 with a bottom pivot pin 204. A second end of the top pair of arms 196 is slidingly coupled to the first hinge mount 192 with a guideway pin 212 that slides in guideways 206 formed in the hinge mount 192. Similarly, a first end of the bottom pair of arms 198 is pivotally coupled to the first hinge mount 192 with a top pivot pin 200. A second end of the bottom pair of arms 198 is slidingly coupled to the second hinge mount 194 with a guideway pin 214 that slides in guideways 208 formed in the hinge mount 194. The pairs of arms 196 and 198 are pivotally coupled together with a middle pivot pin 202. A relief 210 may be formed in the first and second hinge mounts 192 and 194 to allow the hinge mounts to pivot into an open position without the arms binding on the hinge mounts. Holes 216 are formed in the hinge mounts to allow the hinge mounts to be attached to a sign.

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open ended sense in that elements in addition to those enumerated may also be present. Other examples will be apparent to those of skill in the art upon reviewing this document.

What is claimed is:

1. An apparatus for folding a highway safety sign, the apparatus comprising:
- a hinge capable of coupling to first and second halves of a sign, said hinge having:
  - a first hinge mount attachable to the first half of sign;
  - a second hinge mount attachable to the second half of sign;
- a first brace attachable to the first half of the sign and engaged to the first hinge mount of the hinge;
- a second brace attachable to the second half of the sign and engaged to the second hinge mount of the hinge;
- an articulating support member having a first end pivotally attached to the first brace and a second end pivotally attached to the second brace; and
- an actuator having a first end pivotally coupled to said hinge and having a second end pivotally coupled to the articulating support member.

2. The apparatus as recited in claim 1, wherein said hinge further includes:
- a first set of arms having first ends pivotally attached to said first hinge mount and having second ends slidingly engaged to said second hinge mount;
- a second set of arms having first ends pivotally attached to said second hinge mount and having second ends slidingly engaged to said first hinge mount.

3. The apparatus as recited in claim 2, further including a pivot pin connecting mid portions of said first and second set of arms.

4. The apparatus as recited in claim 3, wherein said first and second set of arms of said hinge further includes a curved portion having an apex at which the pivot pin connects the mid portions of the first and second set of arms.

5. The apparatus as recited in claim 2, wherein the first end of the actuator is pivotally coupled to at least one of the first and second set of arms of the hinge.

6. The apparatus as recited in claim 2, wherein said hinge further includes guideways in which the second end of the first and second set of arms slide.

7. The apparatus as recited in claim 1, further including first and second spaced apart outer hinges capable of coupling to first and second halves of said sign, wherein said hinge is positioned between the first and second spaced apart outer hinges.

8. The apparatus as recited in claim 1, further including a wireless power switching control coupled to the actuator.

9. The apparatus as recited in claim 8, further including a solar panel to supply energy to the switching control.

10. The apparatus as recited in claim 1, further including a solar panel to supply energy to said actuator.

11. An apparatus for folding a highway safety sign, the apparatus comprising:
- a sign having a first and second separable halves;
- first and second spaced apart floating hinges;
- a third floating hinge positioned between the first and second spaced apart floating hinges;
- each of said first, second, and third floating hinge having:
  - a first hinge mount fixed to the first half of sign;
  - a second hinge mount fixed to the second half of sign;
  - a first set of arms having first ends pivotally attached to said first hinge mount and having second ends slidingly engaged to said second hinge mount;
  - a second set of arms having first ends pivotally attached to said second hinge mount and having second ends slidingly engaged to said first hinge mount; and
  - a pivot pin connecting mid portions of said first and second set of arms;
- a first brace fixed to the first half of the sign and engaged to the first hinge mount of the third floating hinge;
- a second brace fixed to the second half of the sign and engaged to the second hinge mount of the third floating hinge;
- a middle articulating support member having a first end pivotally attached to the first brace and a second end pivotally attached to the second brace; and
- an actuator having a first end pivotally coupled to at least one of the first and second set of arms of the third floating hinge and having a second end pivotally coupled to a joint of the middle articulating support member.

12. The apparatus as recited in claim 11, wherein said first, second, and third floating hinges further include guideways in which the second end of the first and second set of arms slide.

13. The apparatus as recited in claim 11, further including a wireless power switching control coupled to the actuator.

14. The apparatus as recited in claim 11, further including a solar panel to supply energy to said actuator.

15. The apparatus as recited in claim 11, wherein said actuator is of the linear actuation type.

16. An apparatus for folding a highway safety sign, the apparatus comprising:
- a sign having a first and second separable halves;
- first and second spaced apart floating hinges;
- a third floating hinge positioned between the first and second spaced apart floating hinges;
- each of said first, second, and third floating hinge having:
  - a first hinge mount fixed to the first half of sign;
  - a second hinge mount fixed to the second half of sign;
  - a first set of arms having first ends pivotally attached to said first hinge mount and having second ends that slide in guideways of said second hinge mount;

a second set of arms having first ends pivotally attached to said second hinge mount and having second ends that slide in guideways of said first hinge mount; and a pivot pin connecting mid portions of said first and second set of arms;

a first brace fixed to the first half of the sign and engaged to the first hinge mount of the third floating hinge;

a second brace fixed to the second half of the sign and engaged to the second hinge mount of the third floating hinge;

a middle articulating support member having a first end pivotally attached to the first brace and a second end pivotally attached to the second brace; and an actuator having a first end pivotally coupled to at least one of the first and second set of arms of the third floating hinge and having a second end pivotally coupled to a joint of the middle articulating support member.

17. The apparatus as recited in claim 16, further including a wireless power switching control coupled to the actuator.

18. The apparatus as recited in claim 16, further including a solar panel to supply energy to said actuator.

19. The apparatus as recited in claim 17, further including a solar panel to supply energy to the switching control.

20. The apparatus as recited in claim 16, wherein said actuator is of the linear actuation type.

* * * * *